US006398494B1

(12) United States Patent
Clements

(10) Patent No.: US 6,398,494 B1
(45) Date of Patent: Jun. 4, 2002

(54) CENTRIFUGAL PUMP IMPELLER

(75) Inventor: Martin A. Clements, North Royalton, OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 09/567,884

(22) Filed: May 10, 2000

Related U.S. Application Data

(60) Provisional application No. 60/134,271, filed on May 14, 1999.

(51) Int. Cl.[7] ..... F04D 29/44
(52) U.S. Cl. ..... 415/203; 415/206
(58) Field of Search ..... 415/403, 206; 416/223 B

(56) References Cited

U.S. PATENT DOCUMENTS 4,664,592 A 5/1987 Grzina
4,720,242 A 1/1988 Lovisetto
4,826,401 A * 5/1989 Clark et al. ..... 415/206
5,082,425 A 1/1992 Reil et al.
5,106,263 A * 4/1992 Irie ..... 416/223 B
5,108,257 A * 4/1992 Fukazawa et al. ..... 416/223 B
5,180,280 A * 1/1993 Honda ..... 415/206
5,181,828 A * 1/1993 Gilbert et al. ..... 415/206
5,290,236 A * 3/1994 Mathewson ..... 415/206
5,316,440 A * 5/1994 Kijima et al. ..... 415/206

* cited by examiner

*Primary Examiner*—John Kwon
(74) *Attorney, Agent, or Firm*—Fay, Sharpe, Fagan, Minnich & McKee, LLP

(57) ABSTRACT

An impeller for a centrifugal pump is provided. It has an inlet side and an outlet side. Additionally, the impeller has a base, a plurality of guide elements extending from the base fluid flow channels, and a centrally disposed inlet opening. The fluid flow channels defined by the guide elements impart energy to the fluid during rotation of the impeller. The second member serves as a shroud and encloses the fluid flow channels. The centrally disposed inlet opening through the shroud admits fluid into the flow channels of the impeller to then be conducted outwardly upon rotation of the impeller.

17 Claims, 3 Drawing Sheets

CENTRIFUGAL PUMP IMPELLER

This application claims the benefit of U.S. Provisional Application Serial No. 60/134,271, filed on May 14, 1999.

BACKGROUND OF THE INVENTION

1. Field of the Invention

The present invention relates to centrifugal pumps, and more particularly, to an improved impeller for use in a centrifugal pump. The present invention finds particular application in conjunction with an aircraft fuel pump, and it will be described with particular reference thereto. However, it will be appreciated that the present invention is also amenable to other like applications.

2. Discussion of the Art

The impeller rotates within a casing or housing of the pump. A motor rotates the impeller via a shaft which operatively connects the motor to the impeller. Fluid is provided to the impeller through, for example, a centrally disposed inlet located on one or both faces of the impeller. Fluid enters the impeller inlet in an axial direction and, due to the rotation of the impeller, is flows radially outwardly. Finally, the fluid discharges from the impeller along a peripheral edge of the impeller. Meanwhile, the fluid flowing outwardly from the impeller creates a suction at the central inlet of the impeller which serves to continuously draw more fluid into the inlet.

The fluid discharged from the impeller exits at a significantly higher pressure and velocity than when the fluid entered the impeller. The major portion of the velocity energy imparted to the fluid is converted to a pressure head by means of a volute, diffuser, or other system.

Guiding elements or blades are provided on the impeller and are of critical importance with respect to the overall efficiency of the pump. The fluid flows between the impeller blades and the overall impeller construction may be open or closed, i.e., unshrouded or shrouded, respectively. In either case, the fluid is channeled between the impeller blades (that extend axially from the base of the impeller) and the base of the impeller itself. In an open arrangement, the pump housing serves as the remaining side of the fluid passage whereas in a closed fluid flow channel the channels are enclosed by the shroud or sidewalls which rotate with and form an additional component of the impeller.

In the prior arrangements, impellers tend to have large wide-open fluid flow channels running therethrough. Typically, the cross-sectional area of the channel was at least equivalent to the cross-sectional area of the guiding elements themselves. Such an arrangement in a closed centrifugal pump resulted in a substantial amount of drag and recirculation within the channels of the impeller. As a result, the pump suffered substantial efficiency losses and consumed a large amount of power. Additionally, the recirculating fluid caused the impeller to become unstable.

Therefore, it is desirable to provide an improved impeller for centrifugal pumps that is efficient and stable. The present invention contemplates such an invention that overcomes these problems and others.

BRIEF SUMMARY OF THE INVENTION

In accordance with the present invention, an improved impeller for use in a centrifugal pump is provided for minimizing the above-referenced and other disadvantages of the prior art.

In accordance with one aspect of the present invention an impeller for a centrifugal pump is provided. It has an inlet side and an outlet side. Additionally, the impeller comprises one or more fluid flow channels and a centrally disposed inlet opening. The impeller includes a base having a plurality of guiding elements extending therefrom. The fluid flow channels are defined by the guiding elements that serve to impart energy to the fluid during rotation of the impeller. A shroud encloses the fluid flow channels. The centrally disposed inlet opening admits fluid into the flow channels of the impeller to then be conducted outwardly upon rotation of the impeller.

One advantage of the present invention is that it eliminates or substantially reduces recirculation within the impeller fluid flow channels.

Another advantage of the present invention is that it substantially reduces the power required to operate the pump without reducing the pressure discharge from the pump.

Yet another advantage of the present invention is that the impeller remains balanced during rotation.

Still further advantages and benefits of the present invention will become apparent to those of ordinary skill in the art upon reading and understanding the following detailed description of the preferred embodiments.

BRIEF DESCRIPTION OF THE DRAWINGS

The structure, operation and advantages of the presently preferred embodiment of this invention will become further apparent upon consideration of the following description, taken in conjunction with the accompanying drawings. Of course, the drawings are only for purposes of illustrating preferred embodiments and are not to be construed as limiting the invention.

DETAILED DESCRIPTION OF THE INVENTION

Figure 1:
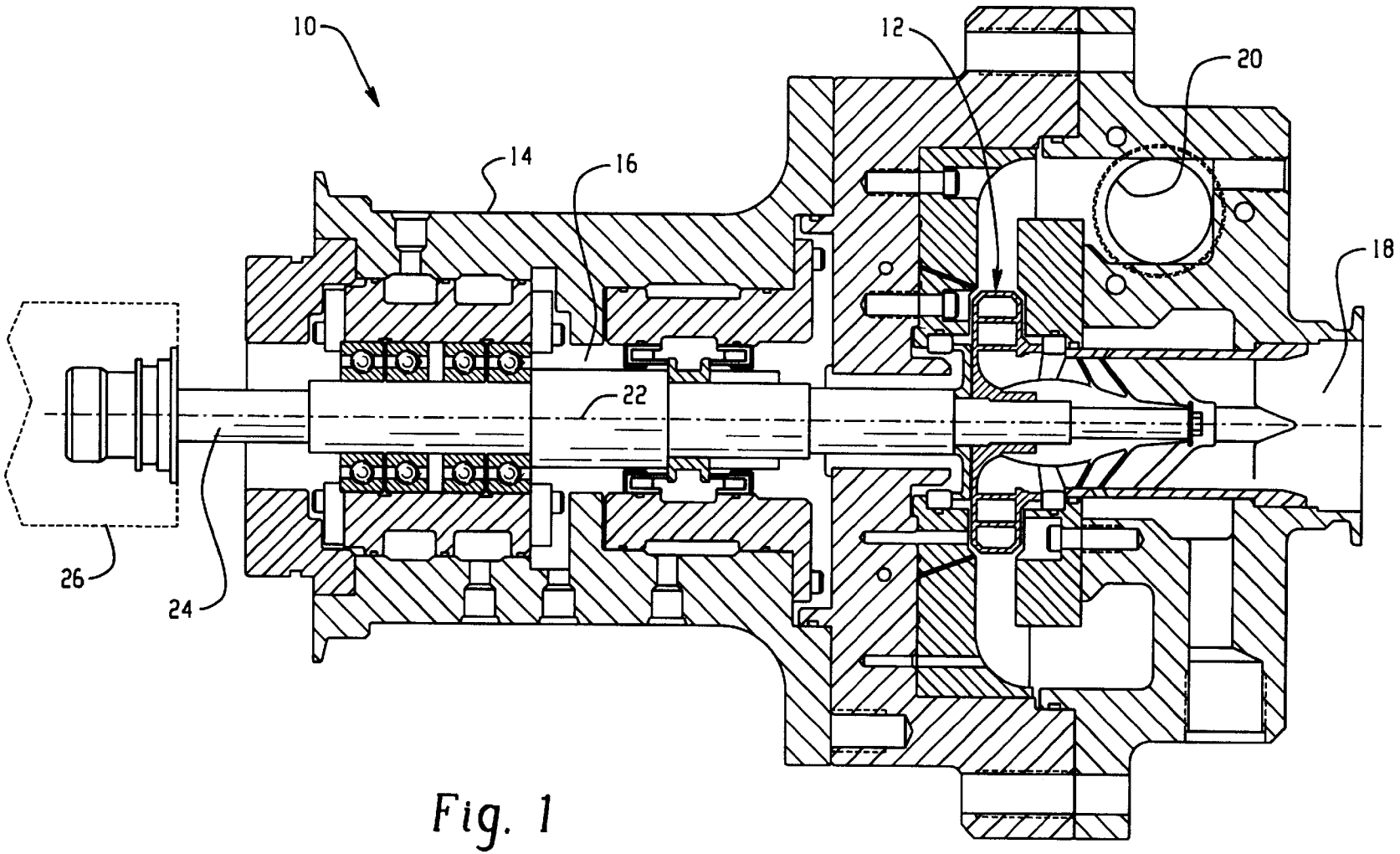
FIG. 1 is a longitudinal cross-sectional view of a centrifugal pump having an impeller in accordance with aspects of the present invention.

With reference to FIG. 1, a centrifugal pump 10 has an impeller 12 rotatably received in a pump casing or housing 14, specifically in an internal chamber 16 of the housing. A pump inlet 18 and pump outlet 20 are provided in the housing to allow fluid to communicate with the internal chamber 16. More particularly, fluid enters the pump inlet at a first pressure and exits the pump outlet at a second, higher pressure.

The impeller 12 is mounted within the pump housing 14 for rotation about a central axis 22 which is preferably aligned with the pump inlet 18. The impeller is secured in a suitable manner to a rotatable shaft 24. Suitable packings are provided to seal around the shaft where it extends into the housing 14. As is well known, one end of the shaft 24 is connected to a motor 26 or other driving device for rotating the shaft, and hence the impeller at relatively high speeds.

As discussed previously, the increase in pressure of the fluid occurs as a result of the impeller 12 increasing the velocity of the fluid during rotation. The velocity is converted into a pressure head by any known means. The housing 14 of the centrifugal pump 10 need not be in any particular form or construction in accordance with the present invention. Likewise, the other components of the centrifugal pump 10 may vary without changing the scope of the present invention.

Figure 2:
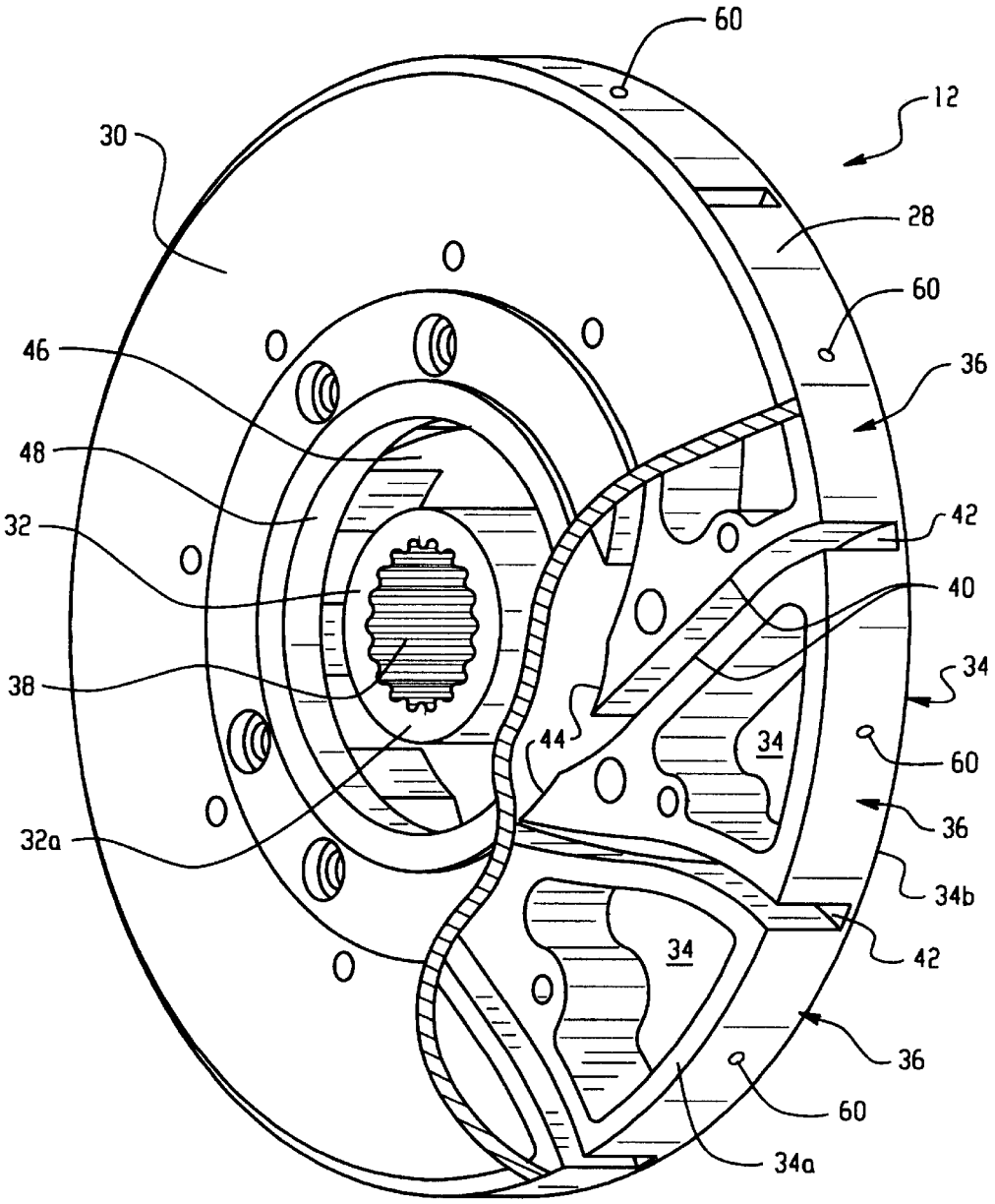
FIG. 2 is a perspective view of an impeller in accordance with aspects of the present invention.
Figure 3:
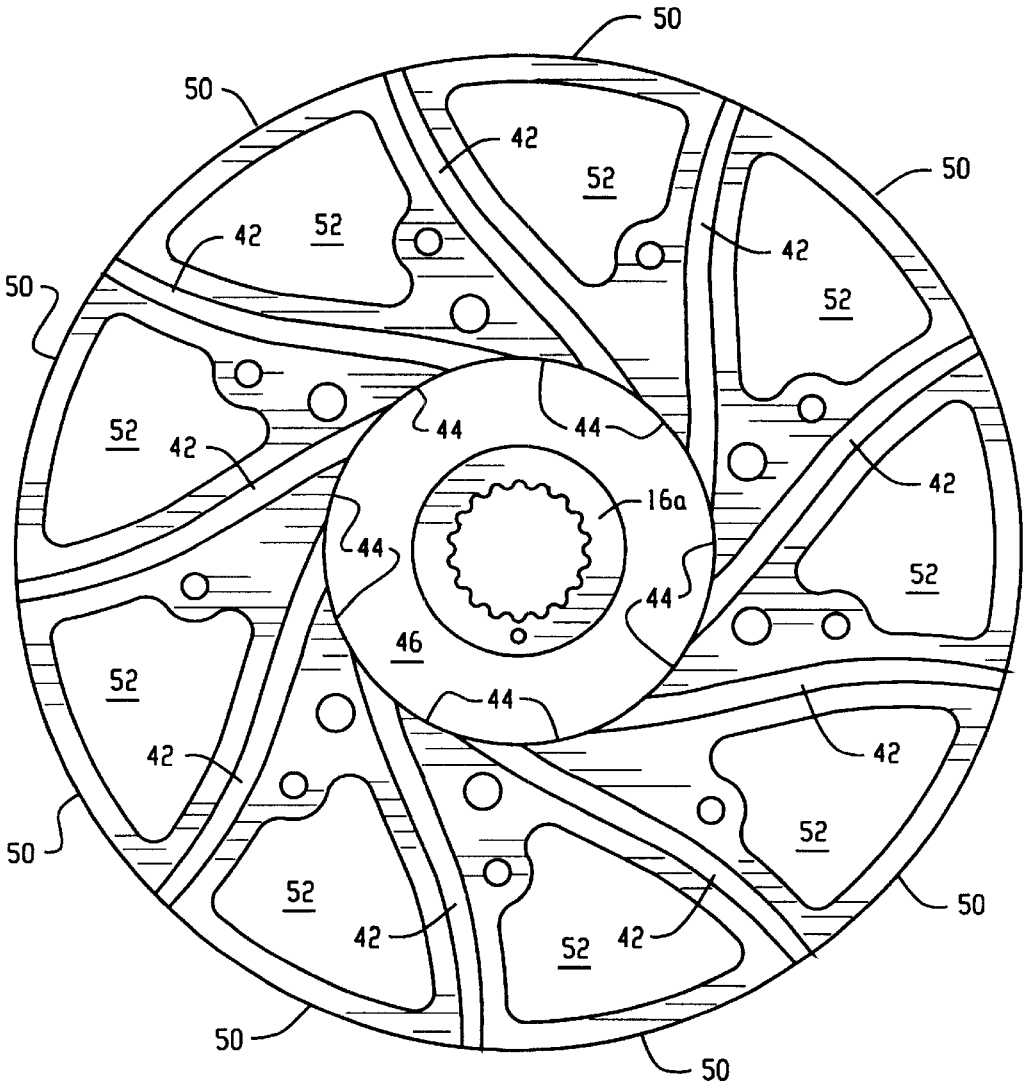
FIG. 3 is a plan view of the impeller illustrated in FIG. 2.

With reference to FIGS. 2 and 3, the impeller 12 is a two component assembly comprising a first member 28 and a second member 30. The first member 28 is generally disk-shaped and comprises a central hub 32 extending from a substantially planar base 34 having a first face 34*a* and second face 34*b*. A first hub portion 32*a* and a plurality of guide elements 36 extend axially from the first face 34*a*. A second hub portion 32b (not shown) extends from the second face 34*b* opposite of the first hub portion 34*a*. The guide elements 36 extend axially outwardly from the base. An opening 38 in the hub and the base receives a shaft which transfers the rotary driving force from a pump motor to the impeller 12.

The guide elements 36 extending from the first face 34*a* of the base define walls 40 of one or more fluid flow channels 42. The walls extend in a curved fashion, i.e., generally radially and circumferentially, although it will be appreciated that curves other than the one illustrated in the Figures could be used without departing from the scope and intent of the subject invention. The first face 34*a* of the base 34 partially also defines a wall of each flow channel 42. An inner wall 44 of each guiding element 36 is radially spaced from the outside diameter of the first hub portion 32*a* to form a centrally disposed inlet chamber 46.

Referring specifically to FIG. 2, the second member or shroud 30 preferably abuts the guiding elements 36 and is axially spaced and parallel to the base 34. The shroud encloses the flow channels 42. Thus, the guide elements 36, the base 34, and the shroud 30 together completely enclose the fluid flow channels 42 which serve to direct fluid radially outwardly from the center of the impeller 12. The shroud 30 is provided with a cylindrical opening 48 which is similar in diameter and concentric with the centrally disposed inlet chamber 46 and allows fluid to enter the impeller 12.

In the preferred embodiment shown in FIGS. 2 and 3, the guide elements 36 are generally triangular or wedge shaped. That is, outer walls 50 of the guide elements 36 are substantially larger (i.e., have greater circumferential dimension) than the inner walls 44. This configuration allows the flow channels 42 to remain relatively narrow in contrast to the prior art. Moreover, the narrow channels have a substantially constant cross-sectional area over their length. This is in stark contrast to the prior art where the channels were substantially wider adjacent the outlet than at the inlet. Thus as is evident in FIG. 3, even though the width of the channels varies slightly between the inlet and the outlet, the sidewalls 40 remain substantially parallel as they curve along their radial and circumferential path.

Further, the guide elements 36 preferably include enlarged hollowed cavities 52 to reduce the overall weight of the impeller 12. A plurality of openings 60 are provided in the outer walls 50 of the guide elements. The openings 60 extend through the outer walls 50 and into the cavities 52 so that upon rotation of the impeller 12, any fluid contained within the cavities 52 is dispelled by centrifugal forces through the openings 60. In particular, fluid may enter the cavities 52 as a result of any imperfections that occur when the shroud is brazed to the base. Imperfect brazing may allow fluid from the fluid channels 42 to enter the cavities 52. By allowing the fluid to exit the cavities 52 during rotation, the impeller remains balanced.

The shroud and the base may be manufactured from conventional materials. Generally, the shroud 30 is brazed to the base, although other means of securing the members 28 and 30 together may be employed. The brazing is preferably provided over the entire surface area where the shroud contacts the base.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the invention, it is now claimed:

1. An impeller for a centrifugal pump comprising:

a base;

a plurality of guide elements extending from the base, each guide element including an enlarged hollow cavity therein and further including a throughhole that communicates with the cavity for allowing fluid trapped in the cavity to exit upon rotation of the impeller;

fluid flow channels defined between the guide elements which impart energy to the fluid during rotation of the impeller;

a shroud enclosing the fluid flow channels; and a centrally disposed inlet opening through the shroud for admitting fluid into the flow channels of the impeller to be conducted radially outwardly upon rotation of the impeller.

2. The impeller of claim 1 wherein the guide elements are generally wedge shaped having a circumferential side and a pair of radial sides that converge toward one another from the circumferential side toward a center of the impeller and the cavities each having a radial width that decreases as the cavity extends from near the circumferential side toward the center of the impeller.

3. The impeller of claim 2 wherein each guide element circumferential side defines a throughhole that connects to the cavity within the guide element for allowing fluid trapped in the cavity to exit upon rotation of the impeller.

4. The impeller of claim 1 wherein the guide elements define narrow flow channels.

5. The impeller of claim 4 wherein the flow channels extend radially outward from the inlet to a circumferential edge of the impeller and axial sides of the flow channels are defined by the impeller base and the impeller shroud along an entire radial length of the flow channels, the base and the shroud forming part of the impeller and rotating with the guide elements upon rotation of the impeller.

6. The impeller of claim 1 wherein at least one opening is provided only in one of the at least one peripheral wall, the one peripheral wall being the wall defining a portion of the circumference of the impeller.

7. The impeller of claim 1 wherein the fluid flow channels have a substantially constant cross-sectional area over the radial extent of the impeller.

8. The impeller of claim 1 wherein the cavities are enclosed on their axial sides by the impeller base and the impeller shroud.

9. The impeller of claim 1 wherein the impeller includes nine fluid flow channels.

10. The impeller of claim 9 wherein the impeller further includes a second disc member axially adjacent the other of the axial sides of the wall portions to define the other axial side of the channels.

11. A centrifugal jet pump for use in an aircraft fuel system comprising:

a housing having a pump inlet and a pump outlet communicating with an internal chamber;

a rotatable shaft operatively received in the chamber; and a generally cylindrical impeller operatively received in the internal chamber and connected to the rotatable shaft, the impeller having a first face, a second face opposite from the first face, and a radial peripheral edge extending around the circumference of the impeller and interconnecting the first and second faces;

the impeller including an impeller inlet located on a face of the impeller, one or more impeller outlets located on the radial peripheral edge, and narrow shrouded channels having a substantially constant width over their extent interposed between the impeller inlet and the impeller outlet whereby fluid is imparted with rotational energy upon rotation of the impeller, the impeller including enlarged hollow cavities for reducing the overall weight of the impeller and openings that communicate with the hollow cavities to allow fluid to exit the cavities during rotation of the impeller.

12. The impeller of claim 11 wherein the openings are disposed in the radial peripheral edge.

13. The impeller of claim 11 wherein the impeller is a closed-type impeller wherein the channels are entirely defined within the impeller.

14. A centrifugal pump assembly for use in an aircraft fuel system comprising:

a housing having an inlet and an outlet communicating with an internal chamber formed in the housing; and an impeller received in the internal chamber adapted for rotation therein about a rotational axis, the impeller having a series of blades defined by wall portions that extend over a face of the impeller for imparting energy to a pumped fluid during rotation of the impeller, the wall portions defining channels that communicate fluid between an inlet and an outlet where the channels have a substantially constant cross-sectional area over the radial extend of the impeller, the wall portions including enlarged hollow cavities positioned between the channels and at least one opening communicating with each cavity for allowing fluid trapped therein to exit upon rotation of the impeller.

15. The impeller of claim 14 wherein the channels are narrow to prevent recirculation of fluid during rotation of the impeller.

16. The impeller of claim 14 wherein openings are disposed in the outer peripheral walls of the blades to allow fluid to exit the cavity during rotation of the impeller.

17. The impeller of claim 14 wherein the impeller includes a first disc member axially adjacent one of the axial sides of the wall portions to define one axial side of the channels.

* * * * *